United States Patent [19]

Heitkamp

[11] 4,224,004

[45] Sep. 23, 1980

[54] KNIFE SHIELD

[75] Inventor: Herbert Heitkamp, Werne, Fed. Rep. of Germany

[73] Assignee: Gewerkschaft Eisenhutte Westfalia, Lunen, Fed. Rep. of Germany

[21] Appl. No.: 933,536

[22] Filed: Aug. 14, 1978

[30] Foreign Application Priority Data

Aug. 12, 1977 [DE] Fed. Rep. of Germany ..... 2736398

[51] Int. Cl.[3] ..... E01G 3/00; E21D 9/06

[52] U.S. Cl. ..... 405/145; 175/61; 175/73; 299/31; 405/141

[58] Field of Search ..... 405/138–146; 173/73; 299/31, 33

[56] References Cited

U.S. PATENT DOCUMENTS

| | | | |
|---|---|---|---|
| 3,326,008 | 6/1967 | Baran et al. | 175/73 X |
| 3,581,507 | 6/1971 | Stevens | 405/145 |
| 3,926,005 | 12/1975 | Foik | 405/145 X |
| 4,048,806 | 9/1977 | Stuckmann et al. | 299/31 X |
| 4,073,153 | 2/1978 | Stuckmann et al. | 405/142 |

*Primary Examiner*—Dennis L. Taylor

*Attorney, Agent, or Firm*—Thompson, Birch, Gauthier & Samuels

[57] ABSTRACT

A knife shield comprises a plurality of elongate knives which are arranged side-by-side upon a common support frame, the knives defining a generally cylindrical shield. Each knife is supported on the frame for movement in its longitudinal direction. At least one pair of diametrically opposed knives are coupled together, in the manner of a trackrod, for conjoint movement with respect to the longitudinal axis of the shield. During this movement the knives of the coupled pair concerned remain substantially parallel. The movement of the knives is used for controlling the direction of advance of the shield.

14 Claims, 4 Drawing Figures

KNIFE SHIELD

BACKGROUND TO THE INVENTION

This invention relates to a knife shield for use in driving tunnels. The term "tunnel" or "tunnels" used throughout this specification is intended to include galleries, trenches and similar elongated excavations.

Knife shields conventionally have a plurality of elongate knives (or planks) mounted side-by-side on a support frame, the knives defining a generally cylindrical shield. The knives can be advanced relative to the frame, either singly or in groups, to extend the tunnel. After all the knives have been advanced, the frame is advanced in a follow-up sequence. Difficulties arise when it is desired to change the direction of advance of such a knife shield, for example, where the required direction of advance follows a curved path, or where corrections have to be made to ensure that the shield follows the desired path. Known knife shields are steered by advancing a number of knives and simultaneously bracing these knives towards the tunnel wall, hydraulic bracing rams being used for this purpose. These hydraulic bracing rams bear against the support frame to effect a tilting of the frame, relative to the axis of the tunnel, in the required direction. Unfortunately, this method of steering is extremely inexact, unreliable and permits no precise control movements.

The main object of the invention is to improve the directional control and steerability of a knife shield and thus make it possible to carry out accurate control movements and directional corrections.

SUMMARY OF THE INVENTION

Fundamentally, this object is met by coupling at least one pair of diametrically opposed knives after the style of a track rod so that when one of the knives is braced towards the adjacent tunnel wall, its opposite knife is moved away from its adjacent tunnel wall.

Thus, according to one aspect of the invention, a knife shield comprises a plurality of elongate knives which are arranged side-by-side so as to define a generally cylindrical shield, each of the knives being supported for movement in its longitudinal direction upon a common support frame, wherein one pair of diametrically opposed knives are coupled together for conjoint movement, with respect to the longitudinal axis of the shield, with the knives of said pair remaining substantially parallel during said movement.

According to another aspect of the invention, a knife shield comprises a plurality of elongate knives which are arranged side-by-side so as to define a generally cylindrical shield, each of the knives being supported for movement in its longitudinal direction upon a common support frame, wherein at least one pair of diametrically opposed knives are coupled together for conjoint movement with respect to the longitudinal axis of the shield, the knives of each said coupled pair remaining substantially parallel during said movement.

Although each pair of coupled knives may be coupled mechanically, it is preferable for such couplings to be hydraulic. Thus, a respective bracing ram may be provided for moving each of the knives radially, the bracing rams being mounted on the support frame, and wherein the bracing rams associated with each pair of coupled knives are coupled together hydraulically for controlling said conjoint movement of those knives.

Advantageously, each pair of diametrically opposed knives are so coupled together. Although it is expedient to couple the knives in pairs, it is also possible to couple pairs of groups of knives, for example, each group may have two knives.

The support frame may be constituted by two frame members which are coupled together by means of a plurality of telescopic guide devices. This permits the frame to be advanced by moving its two frame members forward in successive steps, the stationary frame member forming during each advance step, an abutment for the advancing frame member. The knives also form an abutment for these advancing steps. Since the frame members are loaded by the bracing rams, a trouble-free follow-up of the support frame is guaranteed. Preferably, each frame member is provided with a respective hydraulic bracing ram for each of the knives.

Advantageously, each of the telescopic guide devices is constituted by a first tube fixed to a first of the frame members and a second tube fixed to the second frame member, the first and second tubes of each device being slidingly telescoped together. Preferably, each of the said tubes is of rectangular cross-section. These box shaped tubes have the advantage of preventing twisting and tilting of the two frame members relative to one another. Conveniently, each pair of tubes constituting one of the guide devices accommodates a hydraulic advance ram, the hydraulic advance rams acting between the two frame members.

Preferably, each of the knives is provided with a guide groove which mates with a guide member attached to the piston rod of the associated bracing ram, whereby the knives are slidably guided on the support frame.

Each of the bracing rams may have first and second working chambers on opposite sides of a common piston. Advantageously, the first working chambers of the bracing rams associated with each pair of coupled knives are in direct fluid communication. Preferably, the second working chambers of said bracing rams are each connected to a source of pressurised hydraulic fluid via a respective pressure-regulating valve. Alternatively, the second working chambers of said bracing rams are connected to a source of pressurised hydraulic fluid via a metering cylinder. In this latter case, the metering cylinder may have two chambers on opposite sides of a common piston, one of said chambers being connected to the second working chamber of one of said bracing rams, the other of said chambers being connected to the second working chamber of the other of said bracing rams. In either case, the second working chambers of said bracing rams may be independently pressurisable via a respective valve assembly.

BRIEF DESCRIPTION OF THE DRAWINGS

The invention will now be described in greater detail, by way of example, with reference to the accompanying drawings, in which.

DESCRIPTION OF PREFERRED EMBDOIMENTS

Figure 1:
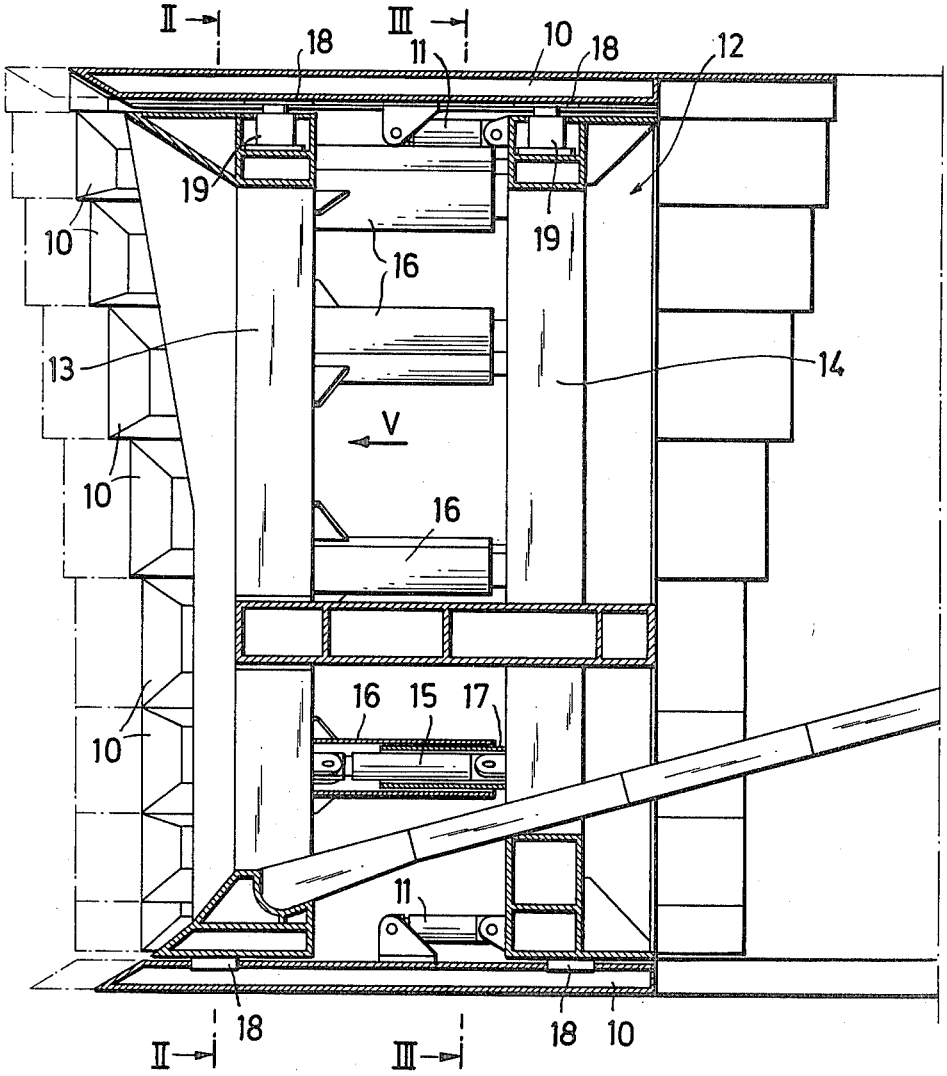
FIG. 1 is a longitudinal cross-section of a knife shield constructed in accordance with the invention.
Figure 2:
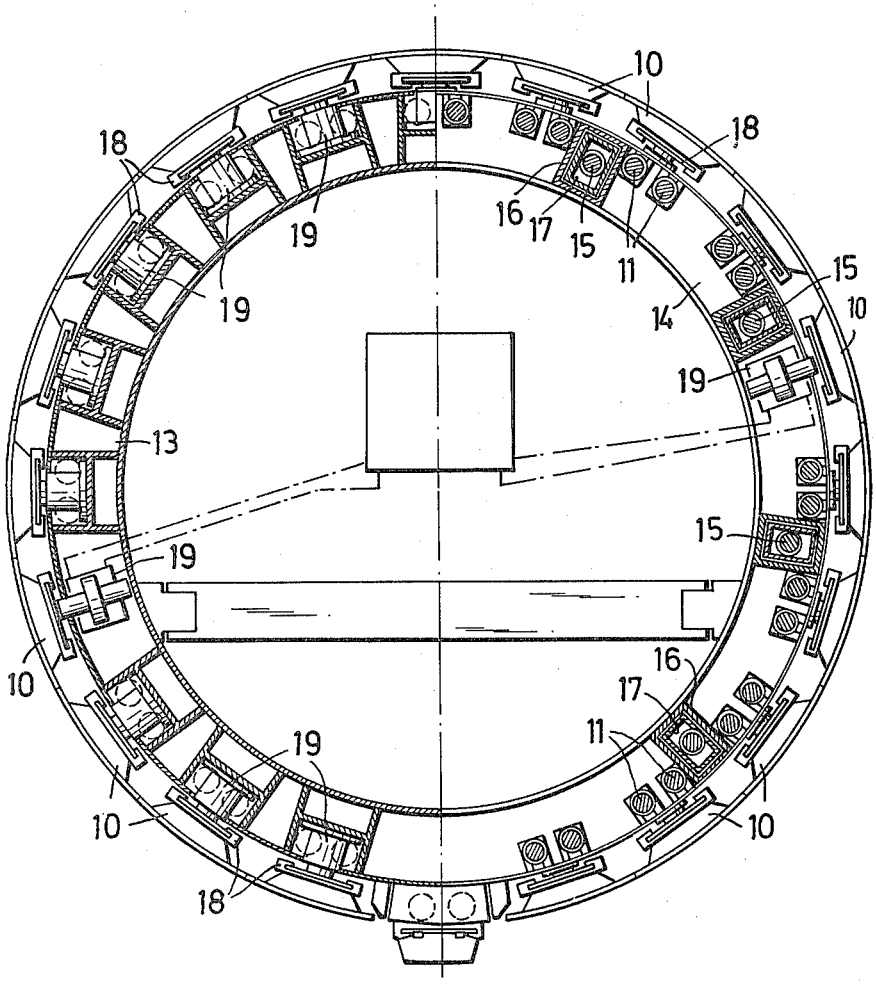
FIG. 2 is a transverse cross-section through the shield of FIG. 1, the left hand side of this section being taken on the line II—II of FIG. 1 and the right hand side on the line III—III of FIG. 1.

Referring to the drawings, FIGS. 1 and 2 show a tunnelling knife shield having a plurality of elongate knives (or planks) 10 which are arranged in a parallel, side-by-side configuration so as to define a cylindrical shield. Each of the knives 10 is provided with a pair of double-acting, hydraulic advance rams II, and each of the knives is supported for movement in the direction of its longitudinal axis upon a common support frame 12. The piston rods of each pair of rams II are connected to the inner surface of the associated knife 10, whereas the cylinders of the rams II are mounted to bear against the support frame 12. Thus, by suitable control of the rams II, the knives 10 can be advanced in the direction of the arrow V, either singly or in groups.

The support frame 12 is constituted by two frame members 13 and 14, which are coupled together by means of a number of double-acting hydraulic advance rams 15, which permit the advance of the two frame members in a follow-up sequence. Each of the rams 15 is associated with a sliding guide which interconnects the two frame members 13 and 14. Each of these sliding guides is constituted by a pair of telescopic tubes 16 and 17 of box-shaped form, the tube 16 being attached to the frame member 13 and the tube 17 being attached to the frame member 14. The tubes 16 and 17 of each pair are relatively slidable but are rotationally fixed. The sliding guides accommodate their associated rams 15 and are distributed at equal angular intervals around the circumference of the annular frame members 13 and 14.

In use, the knives 10 are advanced, either singly or in groups, by means of their rams 11, these rams bearing against the rear frame member 14. As soon as all the knives 10 have been advanced, the support frame is moved forward in a follow-up movement. During this operation, the front frame member 13 is advanced first by extending the rams 15, the sliding guides 16, 17 permitting this advance but preventing relative tilting or rotation between the two frame members 13 and 14 owing to rotational locking between the tubes 16 and 17 of the sliding guides. As soon as the front frame member 13 is fully advanced, the rear frame member 14 is advanced in a follow-up sequence by retracting the rams 15 and/or by retracting the rams 11 associated with the knives.

Each of the knives 10 is slidably supported by the two frame members 13 and 14 by means T-shaped guide grooves 18 formed on its inner surface, these grooves cooperating with mating members attached to the piston rods of hydraulic bracing rams 19 which are arranged around each of the frame members 13 and 14, each knife 10 being acted upon by a respective ram 19 associated with each of the frame members. These bracing rams 19 act radially to press the knives 10 against the wall of the excavation (not shown).

The knives 10 of each pair of diametrically opposed knives are coupled together in such a manner that they can move together with respect to the longitudinal axis of the knife shield. This coupling can be accomplished by mechanical linkages, but it is preferable if hydraulic coupling is used. FIG. 2 shows diagrammatically in dash-dot lines the hydraulic coupling between the knives 10 of one pair of diametrically opposed knives.

Figure 3:
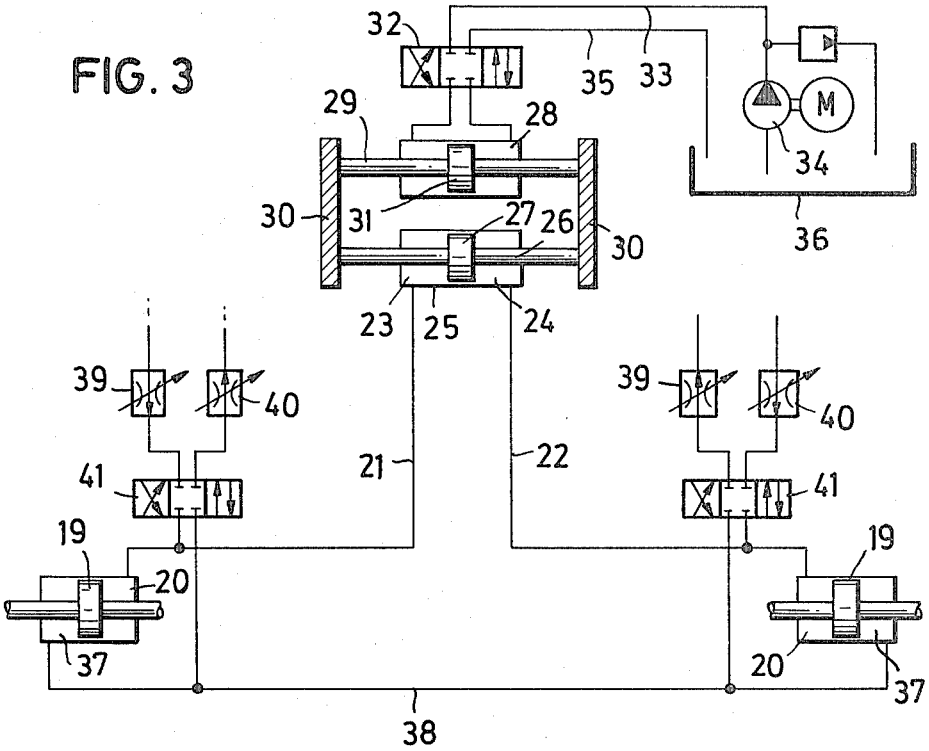
FIGS. 3 and 4 show schematically two forms of hydraulic control arrangements for a given pair of diametrically opposite knives of the shield of FIGS. 1 and 2.

A preferred form of this hydraulic coupling is shown in FIG. 3. Here, the two bracing rams 19 of each pair of rams associated with the diametrically opposed knives 10 have their working chambers 20 connected, via lines 21 and 22, to the two opposite working chambers 23 and 24 of a metering cylinder 25 (though FIG. 3 shows only one such pair of rams and the associated control system). The piston 27 of the metering cylinder 25 is carried by a piston rod 26 which passes right through the metering cylinder, the two ends of this piston rod being fixed to a piston rod 29 of a control cylinder 28 by means of links 30. The piston rod 29 carries a piston 31 which is reciprocable within the control cylinder 28, this reciprocal movement of the piston rod 29 being transmitted to the piston rod 26 via the links 30. The control cylinder 28 is controlled by means of a multi-way control valve 32, the input of which is connected, via a line 33, to a hydraulic pump 34 which is supplied with hydraulic fluid by a reservoir 36. The input side of the control valve 32 is also connected to the reservoir 36 via a return line 35. Thus, reversal of the valve 32 leads to a reversal of the direction of movement of the piston 31 within the control cylinder 28 and hence reversal of the direction of movement of the piston 27 within the metering cylinder 25.

The other working chambers 37 of the two bracing rams 19 are in direct fluid communication via a line 38. Thus, when the piston 27 of the metering cylinder 25 moves to the left (as seen in FIG. 3), a metered amount of hydraulic fluid is forced, via the line 21, from the working chamber 23 of the metering cylinder 25, into the working chamber 20 of the left-hand bracing ram 19, while a corresponding amount of fluid is forced, via the line 22, out of the working chamber 20 of the right-hand bracing ram 19 into the working chamber 24 of the metering cylinder. The piston of the left-hand bracing ram 19 thus moves a predetermined distance to the left (as seen in FIG. 3), the amount of hydraulic fluid forced out of the working chamber 37 of this left-hand ram being conveyed, via the line 38, to the working chamber 37 of the right-hand ram. Consequently, the piston of the right-hand ram 19 also moves, by substantially the same predetermined distance, to the left. The arrangement is, therefore, such that one of the rams 19 (say the left-hand one) can be pressurised to brace the associated knife 10 towards the wall of the excavation, whilst the other ram (in this case the right-hand one) is pressurised so as to retract the associated knife 10, the two knives moving in synchronism and in parallelism. In other words, the two knives 10 move as if controlled by a "hydraulic track rod". Obviously, each pair of diametrically opposed knives 10 could be provided with a similar hydraulic control system so that control of the direction of advance can be effected in any desired direction.

In order that the two rams 19 of each coupled pair may be moved independently (for example, for correcting the positions of the knives 10), each bracing ram is provided with two pressure-regulating valves 39 and 40, one of these valves having its inlet connected to the pressure line 33 and the other having its inlet connected to the return line 35. The outlets of both valves 39 and 40 are connected to the input side of a control valve 41 a 2/3 way slide valve), the outlets of which are connected to the lines 21, 38 and 22, 38 as shown. By suitable control of the valves 41, therefore, the bracing rams 19 can be pressurised in any desired manner independently of the hydraulic coupling.

Figure 4:
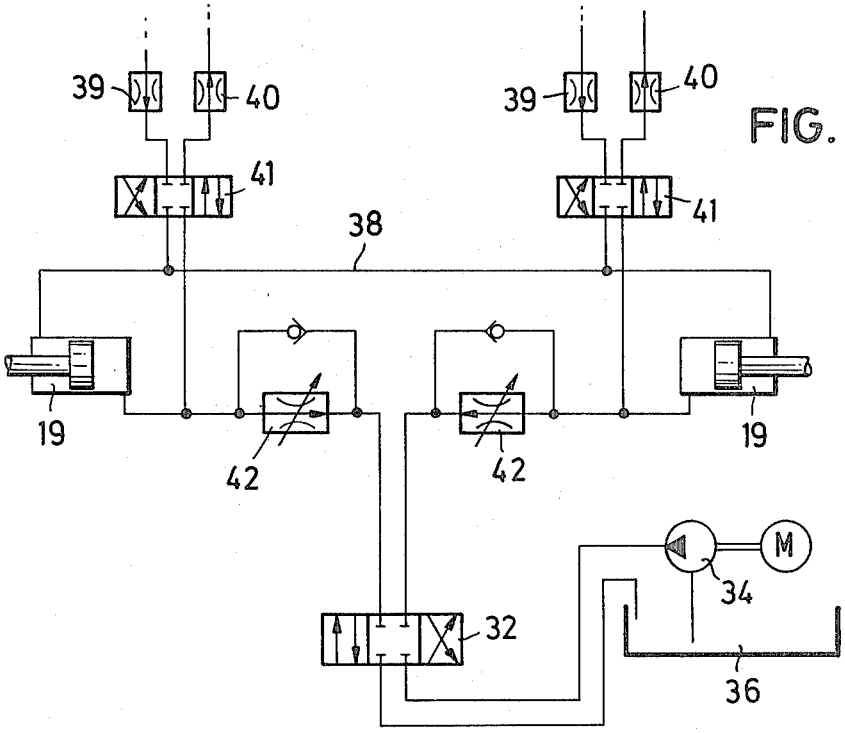

An alternative form of hydraulic coupling is shown in FIG. 4, this form of coupling differing from that of FIG. 3 essentially only in that the metering cylinder 25 of the earlier embodiment is replaced by a pair of pressure-regulating valves 42. These valves 42 are connected to the output side of the control valve 32 and are such that, as one ram 19 is extended, the other ram 19 is retracted by the same distance. Thus, here again, the knives 10 associated with the rams 19 move together in synchronism and parallelism.

The hydraulic control systems described above each permit accurate control of the direction of advance of the knife shield. Moreover, each system permits the knife shield to be controlled by a small computer which determines any deviation of the shield from the required path, and effects the necessary corrections via the control systems. In this way, automatic control of the shield advance is achieved. Moreover, although the described control systems depend upon the quantity (FIG. 3) or pressure (FIG. 4) of hydraulic fluid, similar systems could depend upon a time or distance parameter.

I claim:

1. A knife shield comprising: a plurality of elongate knives which are arranged side-by-side so as to define a generally cylindrical shield surrounding a support frame, each of said knives being mounted for movement in its longitudinal direction upon a respective elongate guide member, said guide members being carried on hydraulic bracing rams mounted on said support frame, said bracing rams acting on said guide members to move the knives associated therewith radially with respect to the longitudinal axis of said shield, and means for hydraulically coupling the bracing rams acting on the guide means of diametrically opposed knives so as to move said diametrically opposed knives conjointly while maintaining a parallel relationship therebetween.

2. A knife shield according to claim 1, wherein the support frame is constituted by two frame members which are coupled together by means of a plurality of telescopic guide devices.

3. A knife shield according to claim 2, wherein each of the telescopic guide devices is constituted by a first tube fixed to a first of the frame members and a second tube fixed to the second frame member, the first and second tubes of each device being slidingly telescoped together.

4. A knife shield according to claim 3, wherein each of said tubes is of rectangular cross-section.

5. A knife shield according to claim 4, wherein each pair of tubes constituting one of the guide devices accommodates a hydraulic advance ram, the hydraulic advance rams acting between the two frame members.

6. A knife shield according to claim 1, wherein each of the knives is provided with a guide groove which mates with a respective guide member attached to the piston rod of the associated bracing ram, whereby the knives are slidably guided on the support frame.

7. A knife shield according to claim 1, wherein each of the bracing rams has first and second working chambers on opposite sides of a common piston.

8. A knife shield according to claim 7, wherein the first working chambers of the bracing rams associated with each pair of coupled knives are in direct fluid communication.

9. A knife shield according to claim 8, wherein the second working chambers of said bracing rams are each connected to a source of pressurised hydraulic fluid via a respective pressure-regulating valve.

10. A knife shield according to claim 8, wherein the second working chambers of said bracing rams are connected to a source of pressurised hydraulic fluid via a metering cylinder.

11. A knife shield according to claim 10, wherein the metering cylinder has two chambers on opposite sides of a common piston, one of said chambers being connected to the second working chamber of one of said bracing rams, the other of said chambers being connected to the second working chamber of the other of said bracing rams.

12. A knife shield according to claim 8, wherein the second working chambers of said bracing rams are independently pressurisable via a respective valve assembly.

13. A knife shield according to claim 2, wherein each frame member is provided with a respective hydraulic bracing ram for each of the knives, and wherein the two pairs of bracing rams associated with each pair of coupled knives are each coupled together hydraulically for controlling said conjoint movement.

14. A knife shield according to claim 1, further comprising a computerised control system for controlling said conjoint movement of each pair of coupled knives.

* * * * *